US005992279A

United States Patent [19]

Hinz

[11] Patent Number: 5,992,279

[45] Date of Patent: Nov. 30, 1999

[54] SLITTING DEVICE TO SLIT A MATERIAL WEB

[75] Inventor: Joachim Hinz, Kempen, Germany

[73] Assignee: Voith Sulzer Finishing GmbH, Krefeld, Germany

[21] Appl. No.: 09/097,399

[22] Filed: Jun. 16, 1998

[30] Foreign Application Priority Data

Jun. 28, 1997 [DE] Germany ..... 197 27 571

[51] Int. Cl.[6] ..... B26D 1/24

[52] U.S. Cl. ..... 83/13; 83/433; 83/504; 83/698.21

[58] Field of Search ..... 83/433, 481, 482, 83/496, 498, 501, 500, 504, 676, 698.21, 698.41, 13, 499, 508.2, 508.3, 575, 576, 577

[56] References Cited

U.S. PATENT DOCUMENTS

| | | | |
|---|---|---|---|
| 3,089,376 | 5/1963 | Whistler et al. | 83/698.21 |
| 3,786,705 | 1/1974 | Dorfel | 83/504 |
| 3,878,412 | 4/1975 | Kurpanek | 83/576 |
| 3,886,833 | 6/1975 | Gunn et al. | 83/504 |
| 4,092,886 | 6/1978 | Norwisch | 83/500 |
| 4,152,962 | 5/1979 | Hendrischk | 83/482 |
| 4,170,159 | 10/1979 | McNally | 83/504 |
| 4,730,529 | 3/1988 | Schroder | 83/504 |

FOREIGN PATENT DOCUMENTS

| | | |
|---|---|---|
| 1510853 | 4/1971 | Germany . |
| 4113797 | 11/1991 | Germany . |
| 19545220 | 6/1997 | Germany . |

OTHER PUBLICATIONS

David K. Cheng, Field and Wave Electromagnetics, Addison–Wesley Publishing Company, Fig. 6–33, p. 290, Jan. 1991.

*Primary Examiner*—Rinaldi I. Rada
*Assistant Examiner*—Gyounghyun Bae
*Attorney, Agent, or Firm*—Greenblum & Berstein, P.L.C.

[57] ABSTRACT

Slitting device and process for positioning a slitting device to slit a material web into partial webs. The slitting device includes a knife arrangement that is adapted for movement transversely to a web run direction of the material web and that includes a first knife attachment device positioned on one side of the material web and a second knife attachment device positioned on an other side of the material web. The first knife attachment device includes a drive with a positioning unit. The slitting device also includes a circuitless signal transmission path that is located between the first knife attachment device and the second knife attachment device and the second knife attachment device includes a follow-up device. The process includes contactlessly coupling the first and second knife attachment devices, and transversely moving the first knife attachment device across a width of the material web. The contactless coupling includes transmitting information related to the transverse movement of the first knife attachment device to the second knife attachment device, and the process further includes transversely moving the second knife attachment device in accordance with the transmitted information.

22 Claims, 1 Drawing Sheet

SLITTING DEVICE TO SLIT A MATERIAL WEB

CROSS-REFERENCE TO RELATED APPLICATIONS

The present application claims priority under 35 U.S.C. § 119 of German Patent Application No. 197 27 571.0, filed on Jun. 28, 1997, the disclosure of which is expressly incorporated by reference herein in its entirety.

BACKGROUND OF THE INVENTION

1. Field of the Invention

The present invention relates to a slitting device to slit a material web into partial webs and a process for positioning a slitting device. The slitting device includes a knife arrangement that is movable transverse to a run direction of the material web. The knife arrangement includes a first knife attachment device positioned on one side of the material web and a second knife attachment device positioned on the other side of the material web. Further, the first knife attachment device includes a drive device with a positioning unit.

While the exemplary embodiments of the present invention describe the material web as a paper web, it is noted that other material webs, e.g., foils, may also be slit into partial webs utilizing the slitting device of the present invention.

2. Discussion of Background Information

Paper webs are often manufactured having widths that are too wide for a subsequent use or application. For this reason, the material webs are often slit, e.g., in one of the final processing steps, to a necessary or desired width. In this manner, many adjacently running partial webs may be formed from a single material web to be wound into many partial web rolls. Further, during the slitting of the material web, a straightening of the edges may be obtained.

Depending on the needs of the subsequent user of the paper webs, the partial webs generally have different and varying widths. Thus, a knife arrangement that is adjustable transversely to a run direction of the material web is preferred. The knife arrangement, if operating under a scissor-cut principle, generally includes two knife attachment devices, i.e., an upper knife and a lower knife. To ensure a clean cut, both knife attachment devices must be positioned precisely relative to one another. In the current state of the art, there are two acceptable possibilities to provide this positioning. First, the upper knife is connected mechanically to the lower knife during a new positioning. However, in this case, the material web may no longer be present between the two knife attachment devices, and both units are moved together in a coupled state into their new position, fixed there, and then decoupled from one another. Thus, this possibility requires a drive for each knife arrangement, a positioning unit, and a mechanical coupling device. Moreover, it is disadvantageous that an adjustment cannot be performed while the a paper web runs through the slitting device. Thus, this possibility does not allow for positioning of a second set of knife arrangements, e.g., to be utilized in a subsequent slitting process, while a material web is being slit. The ability to perform such an adjustment which would reduce set-up time.

In the second possible method, both knife arrangements are displaced independent of each other and positioned. Thus, while this method can be performed with a drawn-in paper web, each knife attachment device requires a drive and a positioning unit, i.e., a total of two drives and two positioning units. In addition to the increased industrial expenditure, the precision of the adjustment is sometimes decreased when utilizing this procedure because each knife attachment device is positioned relative to an individual point of reference, e.g., via counting angle increments moved by a wheel during the moving of the knife attachment devices. Length variations may arise between the rails of the upper and lower knife when utilizing this procedure if, e.g., the temperatures of both places are different, which certainly can occur during operation. Moreover, the combination of the drawbacks of both positioning units add up so as to diminish the exactness of positioning.

SUMMARY OF THE INVENTION

The present invention provides for a precise and rapid adjustment possibility of a knife arrangement.

The present invention provides a slitting device of the type generally discussed above that includes a circuitless (wireless; contactless) signal transmission path that is positioned between a first knife attachment device and a second knife attachment device. The second knife attachment device may also include a follow-up device.

As in the prior art, the first knife attachment device may be positioned via its drive to a predetermined position. However, in accordance with the present invention, the second knife attachment device follows the first knife attachment device via a signal transmission path. In this manner, the signal transmission path substantially ensures that a necessary positioning signal for a point corresponding to the position of the first knife attachment device is provided in a region of the second knife attachment device. Thus, the second knife attachment device is not positioned opposite a point of reference, but moves substantially with, i.e., follows, the first knife attachment device. In this manner, the possibility of a positioning error is substantially eliminated. Since the second knife attachment device follows the first knife attachment device, an opportunity for very rapid adjustment arises, i.e., both knife attachment devices are adjusted practically simultaneously.

Because the signal transmission path is of a circuitless (contactless; wireless) construction, the paper web may remain drawn in between the two knife attachment devices without interfering with the positioning.

In a particular embodiment of the present invention, a magnetic field producing unit may be positioned on at least one end of the signal transmission path. A magnetic field can penetrate almost every material web, in particular a paper web, and can be perceived on the other side of the material web. Thus, a magnetic field is a suitable signal to be transmitted over the signal transmission path to the other knife attachment device. Moreover, the magnetic field may be oriented, at least over a short distance, so that a relatively precise positioning of the other knife attachment device is enabled.

In another embodiment of the present invention, the magnetic field producing device may be composed of an electromagnet. In this manner, the magnetic field may be selectively turned on and off. This may be particularly advantageous if the material webs are slit with a slitting device that is electrically conductive. Thus, the electromagnet may be turned off during extended operations, so that a magnetic field no longer exists between the two knife attachment devices.

In an advantageous embodiment of the present invention, a follow-up device may be formed by a magnetic coupling between the first and second knife attachment devices to substantially simultaneously use the magnetic field for two purposes. First, the position of the one knife attachment device is transferred or conveyed to the other knife attachment device via the magnetic field, and second, the other knife attachment device may be subsequently drawn or moved via movement of the first knife attachment device. In this manner, a magnetic field may be utilized to execute the contactless coupling of the first and second knife attachment devices and the positioning of the second knife attachment device relative to the position of the first knife attachment device. Thus, the necessity of a mechanical connection between the two knife attachment devices is eliminated.

A magnetic field producing device may be preferably positioned on both knife attachment devices with field orientations oriented in the same direction, thus, producing a very strong magnetic coupling. This coupling is stronger than a simple coupling of a magnetic field to a piece of iron lying opposite of it. The two magnetic field producing devices lying opposite one another thus position the two knife attachment devices so that deviations in the fields are minimal. In other words, the two knife attachment devices are automatically positioned relative to one another so that the condition of the lowest energy is produced. However, with an appropriate arrangement of the magnetic field producing devices on the knife attachment devices, this may be substantially exactly the relative position that is desired.

The second knife attachment device may advantageously include an individual drive coupled with a receiver at an end of the signal transmission path to receive a localized signal maximum of a field generated at the first knife attachment. This measure can be provided in addition to, or as an alternative to, the "magnet drive". The individual drive of the second knife attachment device is indeed an additional drive. However, because the knife attachment device is moved, the positioning can be simplified so that the receiver discerns a local signal maximum of the signal (or field) transmitted over the signal transmission path. With transmission paths that are not connected by circuits, a certain diffusing of the signal is produced between the transmitter and the receiver, however, a directed signal will include a local signal maximum that can be discerned by the receiver. From the local maximum, the signal strength decreases. Thus, the conveying of the local maximum is relatively simple to accomplish.

It may be advantageous to form the signal by electromagnetic waves or by an electrostatic field. Both of these possibilities produce a directed signal, e.g., a light beam, which goes through paper, and other electromagnetic waves, e.g., radio signals, may also be utilized in accordance with the features of the present invention. Waves or fields of this type may be produced relatively easily and may be perceived relatively easily so that the corresponding receivers or sensors can be realized with relatively low expenditure.

The first knife attachment device may be advantageously provided as a lower knife, which must be precisely adjusted to the format of the material web to be slit. The upper knife, which is to be moved approximately to a same position as the lower knife, may be positioned a little less precisely than the lower knife. Thus, the follow-up possibility is sufficient.

The present invention is directed to a slitting device to slit a material web into partial webs that includes a knife arrangement that is adapted for movement transversely to a web run direction of the material web and that includes a first knife attachment device positioned on one side of the material web and a second knife attachment device positioned on an other side of the material web. The first knife attachment device includes a drive with a positioning unit. The slitting device also includes a circuitless signal transmission path that is located between the first knife attachment device and the second knife attachment device and the second knife attachment device includes a follow-up device.

In accordance with another feature of the present invention, a magnetic field producing device may be positioned on at least one end of the signal transmission path. Further, the magnetic field producing device may include an electromagnet.

In accordance with another feature of the present invention, the follow-up device may include a magnetic coupling between the first and the second knife attachment device. Further, magnetic field producing devices that produce magnetic fields with certain field orientations may be provided so that the magnetic field producing devices are positioned on the first and second knife attachment devices in a manner that the certain field orientations of the magnetic field producing devices are oriented in a same direction.

In accordance with another feature of the present invention, the second knife attachment device includes a driver and a receiver coupled at the end of the signal transmission path, such that the driver is coupled to the receiver, a field generator directing a field through the circuitless signal transmission path, the field comprising a local signal maximum, and the receiver being arranged to receive the local signal maximum. Further, the field includes one of electromagnetic waves and an electrostatic field.

In accordance with another feature of the present invention, the first knife attachment device is positioned as a lower knife.

The present invention is directed to a slitting device for forming a plurality of partial webs from a material web. The slitting device includes a first knife attachment device, a second knife attachment device, and a contactless coupling that couples the first and second knife attachment devices. The second knife attachment device is adapted to follow movements of the first knife attachment device.

In accordance with another feature of the present invention, the first knife attachment device includes a first carrier supported on drivable wheels and a drive device for driving the drivable wheels. Further, the second knife attachment device includes a second carrier. Still further, the contactless coupling includes at least one electromagnet positioned at an end of at least one of the first and second carrier, and the at least one electromagnet is arranged to attract the other of the first and second carrier. The second carrier may be supported on passive wheels. Alternatively, the second carrier may be supported on at least one drivable wheel, and may include a drive device for driving the at least one drivable wheel. Further, the contactless coupling may include a receiver mounted to an end of the second carrier and a field generating device coupled to an end of the first carrier. The receiver is coupled to the at least one drivable wheel to move the second carrier in accordance with movements of the first carrier. Further still, the field generating device is adapted to generate one of electromagnetic waves and a electrostatic field.

The present invention is directed to a process for positioning a slitting device for a material web that includes a first knife attachment device and a second knife attachment device. The process includes contactlessly coupling the first and second knife attachment devices, and transversely moving the first knife attachment device across a width of the material web. The contactless coupling includes transmitting information related to the transverse movement of the first knife attachment device to the second knife attachment device, and process also includes transversely moving the second knife attachment device in accordance with the transmitted information.

In accordance with another feature of the present invention, the contactless coupling may include positioning an electromagnet on an end of at least one of the first and second knife attachment devices, and actuating the electromagnet to create an attraction between the first and second knife attachment devices. The transmitted information may be a magnetic field generated by the electromagnet.

In accordance with another feature of the present invention, the contactless coupling may include positioning an electromagnet on an end of the first and second knife attachment devices, orienting the magnetic fields of the electromagnets in a same direction, and actuating the electromagnets to create an attraction between the first and second knife attachment devices. The transmitted information may be a magnetic field generated by the electromagnets.

In accordance with another feature of the present invention, the process further including guiding the material web through the contactless coupling of the first and second knife attachment devices. Thus, the transmitted information penetrates the material web.

In accordance with another feature of the present invention, the contactless coupling includes positioning a field generating device on an end of the first knife attachment device, the field generating device transmitting one of electromagnetic waves and an electrostatic field, and positioning a receiver on an end of the second knife attachment device opposite the field generating device to receive the transmitted field. The transmitted information may be composed of the one of electromagnetic waves and the electrostatic field. Further, the process further includes tuning the receiver to a local signal maximum of the field generating device, coupling the sensor to a driving device for the second knife attachment device, and driving the second knife attachment device in accordance with changes in the received local signal maximum.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
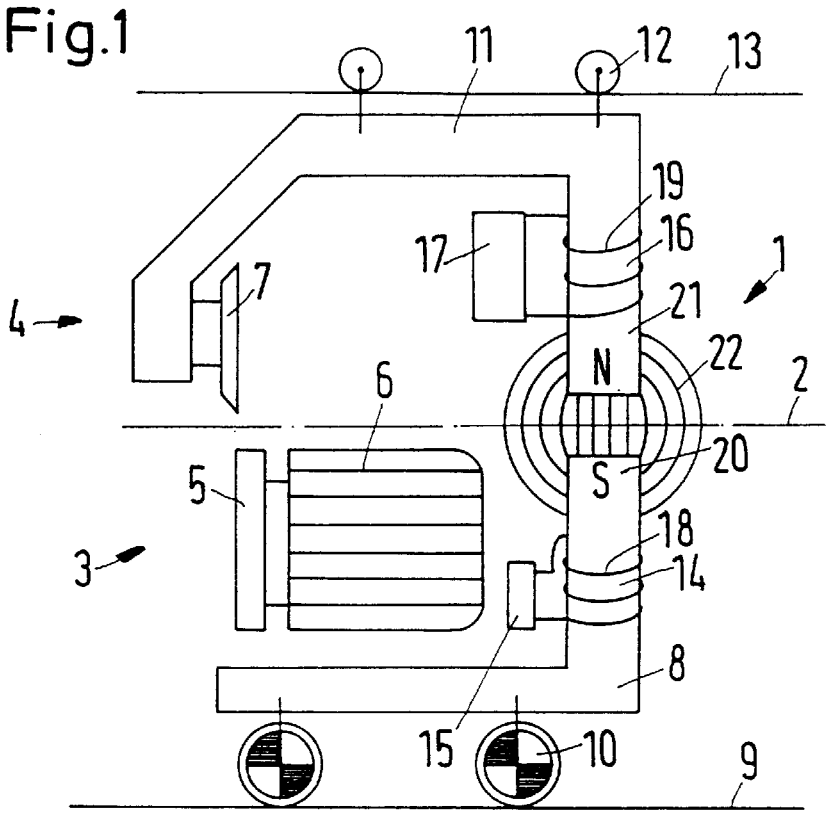
FIG. 1 illustrates a first embodiment of a slitting device in accordance with the present invention.

A slitting device 1 in accordance with a first embodiment of the present invention is illustrated in FIG. 1 and performs a longitudinal slitting of a material web 2, e.g., paper or other similar web material, depicted in a dot-dash line. The slitting device includes a first knife attachment device 3 that is position below paper web 2, and a second knife attachment device 4 that is positioned above paper web 2. First knife attachment device 3 may include a knife 5 that is driven via a motor 6. Knife 5 may be referred to as a "lower knife". Second knife attachment device 4 includes a knife 7 that may be referred to as an "upper knife". Both knives 5 and 7 are shown in the exemplary illustration at a distance from each, however, the distances are somewhat exaggerated for the sake of clarity. In an actual slitting process, knives 5 and 7 are moved closer to each other to effect a scissor-cut, i.e., knives 5 and 7 are positioned to partially overlap and, thereby, descend upon paper web 2. It is apparent that both knives 5 and 7 must be positioned relatively exactly to one another in an axial direction of the material web to ensure that a desired quality results from the cutting.

Knife attachment device 3 may be mounted on a carrier 8 that is movable, e.g., on a rail 9 that extends transversely to a web run direction of material web 2. The position of lower knife 5 may be adjusted or changed in width direction of material web 2 so that different cut lines may be produced. For example, the widths of partial webs that are cut from the material web 2 may vary or differ. In the schematic depiction of FIG. 1, wheels 10 of carrier 8 may be driven. The particular positioning of carrier 8 is generally known, thus, a positioning device utilized for this purpose is not depicted in detail.

Knife attachment device 4 may be positioned on a carrier 11 that is hung on a rail 13, e.g., via wheels 12. Wheels 12 are not driven in this exemplary embodiment.

Lower knife attachment device 3 may include an electromagnet 14 that may be set into operation via a control unit 15. Upper knife attachment device 4 may include an electromagnet 16 that may be set into operation via a control unit 17. Electromagnets 14 and 16 may be formed by spools 18 and 19 that are laid (wound) around yolks 20 and 21 and imparted with a direct current. In this manner, spools 18 and 19 are arranged so that electromagnets 14 and 16 create a magnetic field 22. The north pole N of electromagnet 16 is located opposite the south pole S of electromagnet 14 so that electromagnets 14 and 16 are arranged to attract each other. If electromagnets 14 and 16 are set into operation (actuated) prior to moving carrier 8, then carrier 11 of upper knife attachment device 4 will automatically follow the movements of carrier 8 of lower knife attachment device 3.

The distance between yolks 20 and 21 in the exemplary illustration has been exaggerated for the sake of clarity. In practice, the distance may be only a couple of millimeters. In particular, it is only necessary to provide a distance sufficient to guide material web 2 between electromagnets 14 and 16. The closer the magnets are arranged to each other, i.e., yolks 20 and 21, the more precisely carrier 11, and upper knife attachment device 4, will follow carrier 8 and lower knife attachment device 3. Thus, an individual drive for the upper knife attachment device is not necessary. Accordingly, movement of lower knife attachment device 3 is followedup automatically via the magnetic coupling of electromagnets 14 and 16 to impart movement onto upper knife attachment device 4. Thus, magnetic field 22 has two functions, i.e., to send an information signal to upper knife attachment device 4 via the position of lower knife attachment device 3, and to transmit the forces necessary to drive upper knife attachment device 4.

Figure 2:
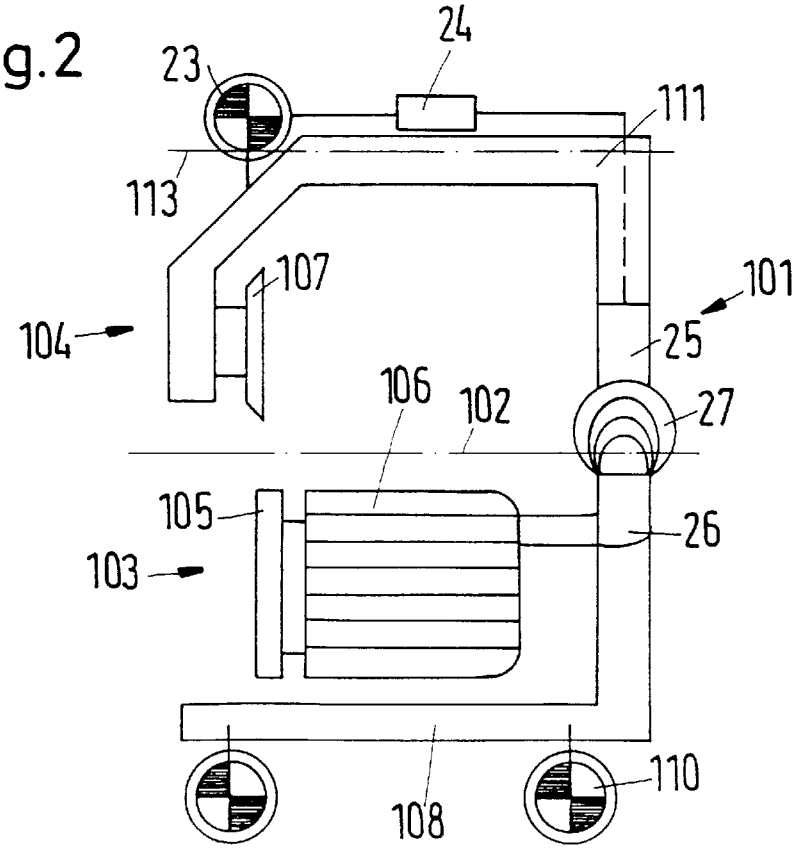
FIG. 2 illustrates a second embodiment of a slitting device in accordance with the present invention.

FIG. 2 shows another embodiment of the present invention in which components that correspond to those depicted in FIG. 1 are provided with reference numerals increased by 100. Slitting device 101 includes a lower knife attachment device 103 and an upper knife attachment device 104. Lower knife attachment device 103 includes a knife 105 and upper knife attachment device 104 includes a knife 107. Knife 105 of the lower knife attachment device 103 may be driven by a motor 106, and lower knife attachment device 103 may be movable on a carrier 108 with propelled or driven wheels 110.

In this alternative embodiment, carrier 111 of upper knife attachment device 104 may moved along rail 113 via a drive 23. Drive 23 may be controlled via a control device 24 coupled to a sensor (receiver) 25. Sensor 25 is positioned to receive a signal emitted by a transmitter 26 that is located on lower knife attachment device 103. In this manner, a circuitless signal transmission path is provided for transmitting a signal between transmitter 26 and sensor 25. This signal may be formed with, e.g., a magnetic field 27, that is known to be undisturbed by material web 102.

Further, other advantageous fields may be utilized as field 27 so as to form the circuitless transmission path. For example, a light beam may be utilized that is capable of being perceived on the other side of material web 102. Alternatively, the signal may be formed by another electromagnetic wave, e.g., in an invisible region, such as a radio signal. Further, field 27 may be formed as an electrostatic field that is produced from transmitter 26.

As is known, signals that are transmitted over transmission paths that are not coupled by a circuit not only expand precisely along the signal transmission path, but that they diffuse. This cannot always be completely avoided even with directed transmitters. Field 27 (or, generally, the signal perceived at sensor 25) includes a local maximum only at one point. This local maximum may be assigned spatially to knife 105 of lower knife attachment device 103. If control device 24 controls drive 23 so that sensor 25 is kept within an area of this local maximum, then carrier 111 of upper knife attachment device 104 can exactly follow carrier 108 of lower knife attachment device 103. Because only a single, relative position determination is necessary between upper knife device 104 and lower knife attachment device 103, mistakes are reduced to a minimum, and the positioning of upper knife attachment device 104 can be provided with a relatively low expenditure.

With both slitting devices 1 and 101 of the present invention, it is possible to position both knife attachment devices 3 and 4 or 103 and 104 relative to each other with great precision. Moreover, the positioning may occur even while paper web 2 or 102 is still running, and without damaging the material web in the process. Thus, the expenditure is relatively low.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A slitting device to slit a material web into partial webs comprising:

a knife arrangement adapted for movement transversely to a web run direction of the material web and including a first knife attachment device positioned on one side of the material web and a second knife attachment device positioned on an other side of the material web;

the first knife attachment device including a drive with a positioning unit;

a circuitless signal transmission path being located between the first knife attachment device and the second knife attachment device; and the second knife attachment device including a follow-up device.

2. The slitting device in accordance with claim 1, further comprising a magnetic field producing device positioned on at least one end of the signal transmission path.

3. The slitting device in accordance with claim 2, the magnetic field producing device comprising an electromagnet.

4. The slitting device in accordance with claim 1, the follow-up device comprising a magnetic coupling between the first and the second knife attachment device.

5. The slitting device in accordance with claim 4, further comprising:

magnetic field producing devices producing magnetic fields with certain field orientations, the magnetic field devices being positioned on the first and second knife attachment devices; and the magnetic field producing devices being oriented so that the certain field orientations are positioned in a same direction.

6. The slitting device in accordance with claims 1, the second knife attachment device including a driver and a receiver coupled at the end of the signal transmission path;

the driver being coupled to the receiver;

a field generator directing a field through the circuitless signal transmission path, the field comprising a local signal maximum; and the receiver being arranged to receive the local signal maximum.

7. The slitting device in accordance with claim 6, the field comprising one of electromagnetic waves and an electrostatic field.

8. The slitting device in accordance with claim 1, the first knife attachment device being positioned as a lower knife.

9. A slitting device for forming a plurality of partial webs from a material web comprising:

a first knife attachment device;

a second knife attachment device;

a contactless coupling that couples the first and second knife attachment devices;

the second knife attachment device being adapted to follow movements of the first knife attachment device.

10. The slitting device in accordance with claim 9, the first knife attachment device comprising a first carrier supported on drivable wheels and a drive device for driving the drivable wheels.

11. The slitting device in accordance with claim 10, the second knife attachment device comprising a second carrier.

12. The slitting device in accordance with claim 11, the contactless coupling comprising at least one electromagnet positioned at an end of at least one of the first and second carrier; and the at least one electromagnet arranged to attract the other of the first and second carrier.

13. The slitting device in accordance with claim 11, the second carrier being supported on passive wheels.

14. The slitting device in accordance with claim 11, the second carrier being supported on at least one drivable wheel, and the second knife attachment device further comprising a drive device for driving the at least one drivable wheel.

15. The slitting device in accordance with claim 14, the contactless coupling comprising:

a receiver mounted to an end of the second carrier and a field generating device coupled to an end of the first carrier; and the receiver coupled to the at least one drivable wheel to move the second carrier in accordance with movements of the first carrier.

16. The slitting device in accordance with claim 15, the field generating device being adapted to generate one of electromagnetic waves and a electrostatic field.

17. A process for positioning a slitting device for a material web, the slitting device including a first knife attachment device and a second knife attachment device, the process comprising:

contactlessly coupling the first and second knife attachment devices;

transversely moving the first knife attachment device across a width of the material web;

the contactless coupling including transmitting information related to the transverse movement of the first knife attachment device to the second knife attachment device;

transversely moving the second knife attachment device in accordance with the transmitted information.

18. The process in accordance with claim 17, the contactless coupling comprising:

positioning an electromagnet on an end of at least one of the first and second knife attachment devices;

actuating the electromagnet to create an attraction between the first and second knife attachment devices, wherein the transmitted information is a magnetic field generated by the electromagnet.

19. The process in accordance with claim 17, the contactless coupling comprising:

positioning an electromagnet on an end of the first and second knife attachment devices;

orienting the magnetic fields of the electromagnets in a same direction;

actuating the electromagnets to create an attraction between the first and second knife attachment devices, wherein the transmitted information is a magnetic field generated by the electromagnets.

20. The process in accordance with claim 17, further comprising:

guiding the material web through the contactless coupling of the first and second knife attachment devices, whereby the transmitted information penetrates the material web.

21. The process in accordance with claim 17, the contactless coupling comprising:

positioning a field generating device on an end of the first knife attachment device, the field generating device transmitting one of electromagnetic waves and an electrostatic field;

positioning a receiver on an end of the second knife attachment device opposite the field generating device to receive the transmitted field, wherein the transmitted information is composed of the one of electromagnetic waves and the electrostatic field.

22. The process in accordance with claim 21, further comprising:

tuning the receiver to a local signal maximum of the field generating device;

coupling the receiver to a driving device for the second knife attachment device; and driving the second knife attachment device in accordance with changes in the received local signal maximum.

* * * * *